US005577729A

United States Patent [19]

Sabour

[11] Patent Number: 5,577,729

[45] Date of Patent: Nov. 26, 1996

[54] HEAD MOVEMENT DETECTOR

[76] Inventor: Max T. Sabour, 175 S. Main St., Ste 1600, Salt Lake City, Utah 84111

[21] Appl. No.: 390,077

[22] Filed: Apr. 24, 1995

[51] Int. Cl.[6] ..... A63B 69/36

[52] U.S. Cl. ..... 273/274

[58] Field of Search ..... 273/190 R, 187.2; 434/252

[56] References Cited

U.S. PATENT DOCUMENTS 3,415,523 12/1968 Boldt ..... 273/190 R X 4,326,718 4/1982 Kiehl ..... 273/190 R X 4,513,972 4/1985 Empie ..... 273/190 R

*Primary Examiner*—George J. Marlo

[57] ABSTRACT

A head movement detector for detecting head movement exceeding the allowable movement(s) for an activity and including a portable base supporting an upright mast, an arm projecting from the top of said mast and having a head attachment apparatus on the free end thereof and electronic signalling means to indicate the extent and nature of undesired excessive head movement in multiple directions and to display such movement while permitting limited allowable movement in such multiple directions without actuation of such signaling means.

18 Claims, 5 Drawing Sheets

HEAD MOVEMENT DETECTOR

FIELD OF THE INVENTION

This invention relates to detectors for signaling head movement in training a user to maintain a steady head while participating in activities where maintaining a steady head is advantageous.

PRIOR ART

It has long been recognized that when performing certain physical activities, such as swinging a golf club at a golf ball or a bat at a baseball, the best results are obtained if the practitioner moves his or her head only within established limits. Many people playing the game of golf, for example, recognize that their heads should move only within established limits while they swing a golf club. These persons may even believe that they are actually correctly holding their heads from movement beyond the established limits, while, in fact, they often-times are actually moving their heads in directions and for distances that are far outside the established desirable range of movement.

In playing golf, head movement can be generally classified in three ways, i.e. (1) from side-to-side, (2) up and down, and (3) toward and away from the ball to target line. Naturally, combinations of these classified movements can, and most often, do occur. In making a good swing a golfer usually has a bit of (1) and some (2) movement and this is perfectly acceptable. Too much of either or both of the (1) or (2) movements will result in flubbed shots, however. Movement (3), whether forward or backward with respect to the ball to target line, means that the golfer's weight is being rocked forwardly or rearwardly on toes and heels. This affects the golfer's balance and can result in shots being struck off the toe or heel of the club being used.

In U.S. Pat. No. 2,252,831 there is shown a device that holds the head and feet of a golfer in a fixed position, while allowing other body parts to move as the user of the device swings a club at a golf ball. This patented structure does not recognize that some limited amount of head movement is not only acceptable, but desirable and does not provide any indication to a user that desired head movement has been exceeded.

U.S. Pat. No. 3,104,880 discloses a golf training device that allows a golfer's head to move to one side during a backstroke but that stops head movement once the head is moved over the point of impact of the club with a golf ball.

U.S. Pat. Nos. 3,243,186, 3,326,558 and 4,326,718 each disclose devices including head movement indicators. U.S. Pat. No. 3,243,186 discloses a support post for an arm having movable components and electrical circuitry that will sound an indicator in response to movement of a cap connected to the arm and placed on a golfer's head.

U.S. Pat. No. 3,326,558 discloses a golfer's head movement indicating device wherein depending members are placed at opposite sides of a user's head. The spacing between the depending members determines an allowable movement of the head, but contact with either depending member will activate a signaling device to indicate that excessive head movement has ocurred.

U.S. Pat. No. 4,326,718 discloses a golf swing training and exercise device that includes, as part of a large multi-function device, an optional head restraining device with an electrical switch that is adjustable for an allowable degree of head movement before it is closed to activate a signal indicating excessive head movement.

BRIEF DESCRIPTION OF THE INVENTION

Objects of the Invention

Principal objects of the present invention are to provide an easily transported and operated head movement detector that can be used in the training of golfers, baseball players and the like, to signal undesired head movement and to indicate to the user the nature of the detected excess movement.

Other objects are to provide a head movement detector that is easily transported, set up for use and used, even by persons having no previous training in the use of the detector.

Features of the Invention

Principle features of the invention include a vertically adustable support mast; a telescoping projecting arm cantilevered from the top of the mast and movable to pivot up and down with respect to the top of the mast and to swivel with respect to the longitudinal shaft of the mast; a headgear attachment pad pivotally mounted on the end of the projecting arm remote from the mast; and circuit means mounted on the projecting arm and including switches actuated by movement of the projecting arm and of the headgear attachment pad relative to the projecting arm to actuate audible and/or visual signaling devices that will be indicative of the type excess head movement detected.

Accomodation is made for allowable head movement and adjustments are provided to vary the allowable head movement in different directions according to the skill of the user and the nature of the game or other activity for which head movement training is being practiced.

Indicators signal excess head movement as such movement occurs and may provide a lasting record of the maximum movements occuring during the activity performed.

Additional objects and features of the invention will become apparent to those skilled in the art to which the invention pertains from the following detailed description and drawings.

THE DRAWINGS

Figure 1:
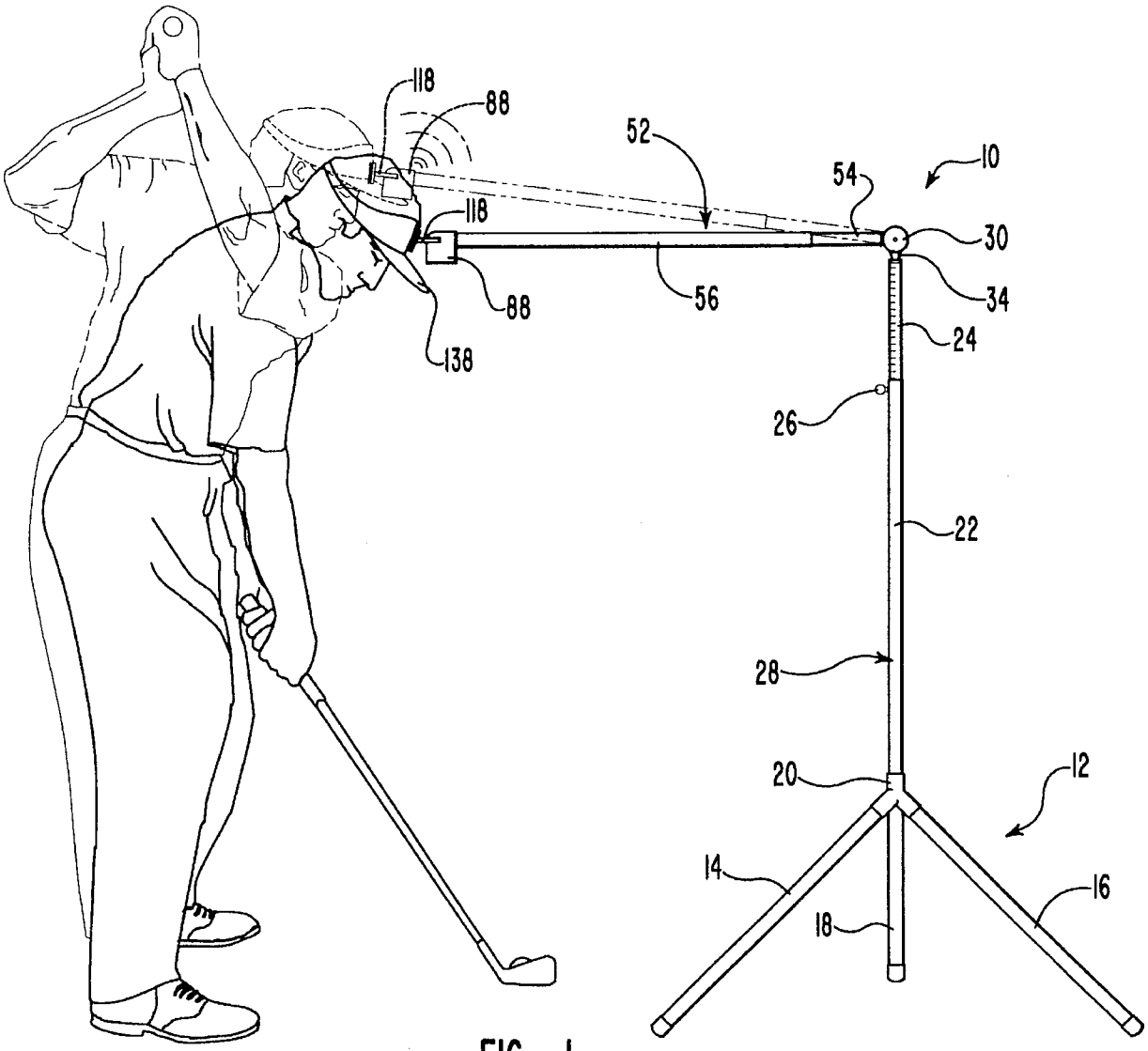
FIG. 1 is a pictorial view of the head movement detector of the invention being used by an individual practicing swinging a golf club.
Figure 2:
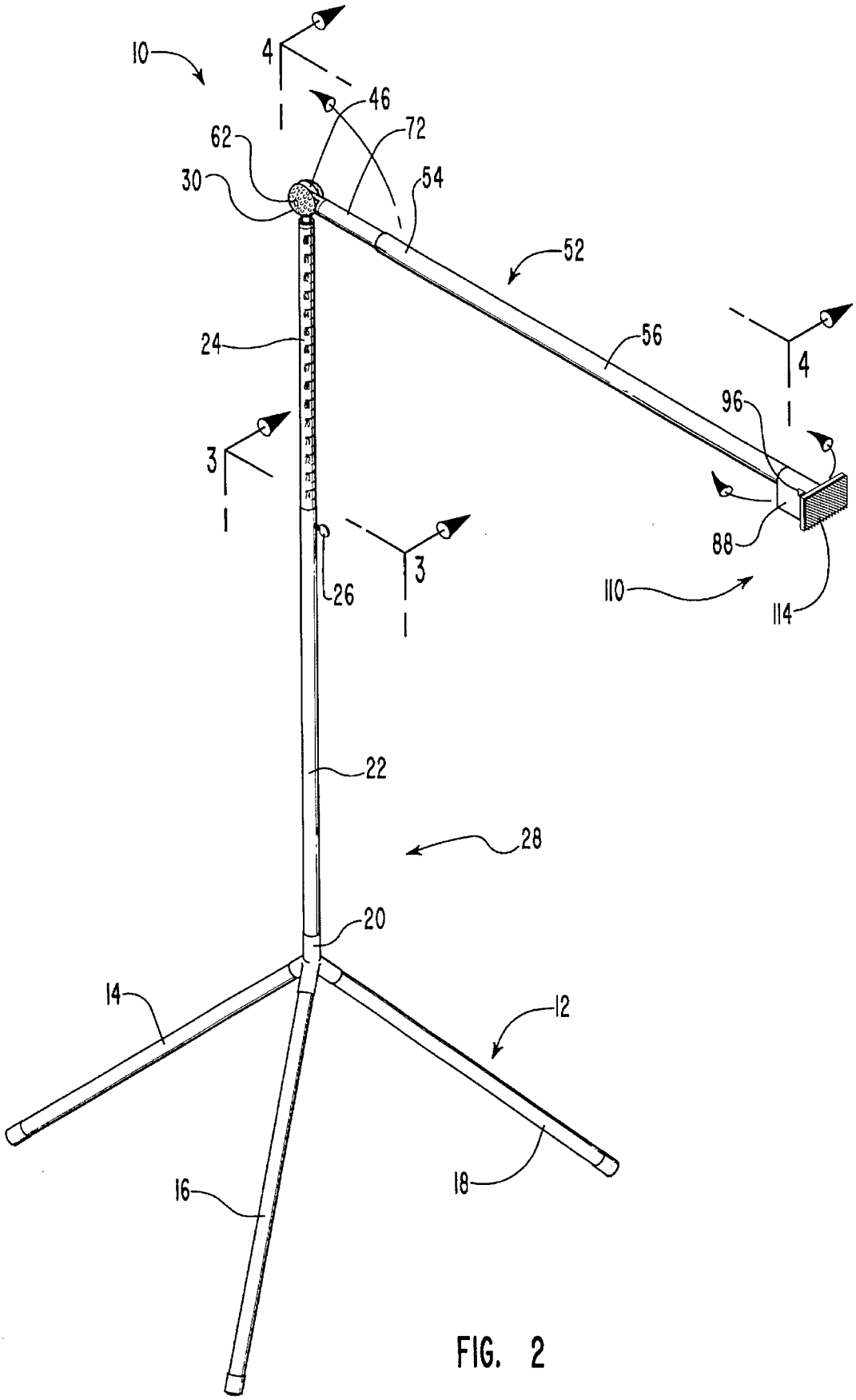
FIG. 2 is a perspective view, taken from one side, slightly above and at the unsupported end of the projecting arm of the head movement detector of the invention.
Figure 3:
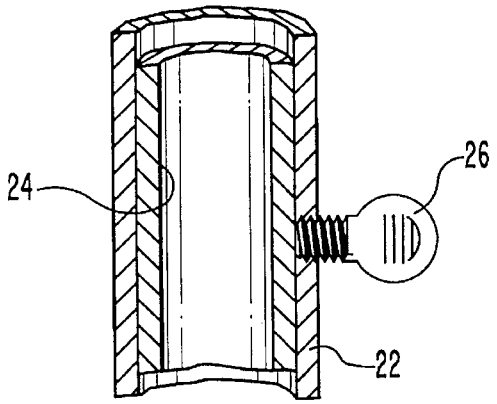
Figure 4:
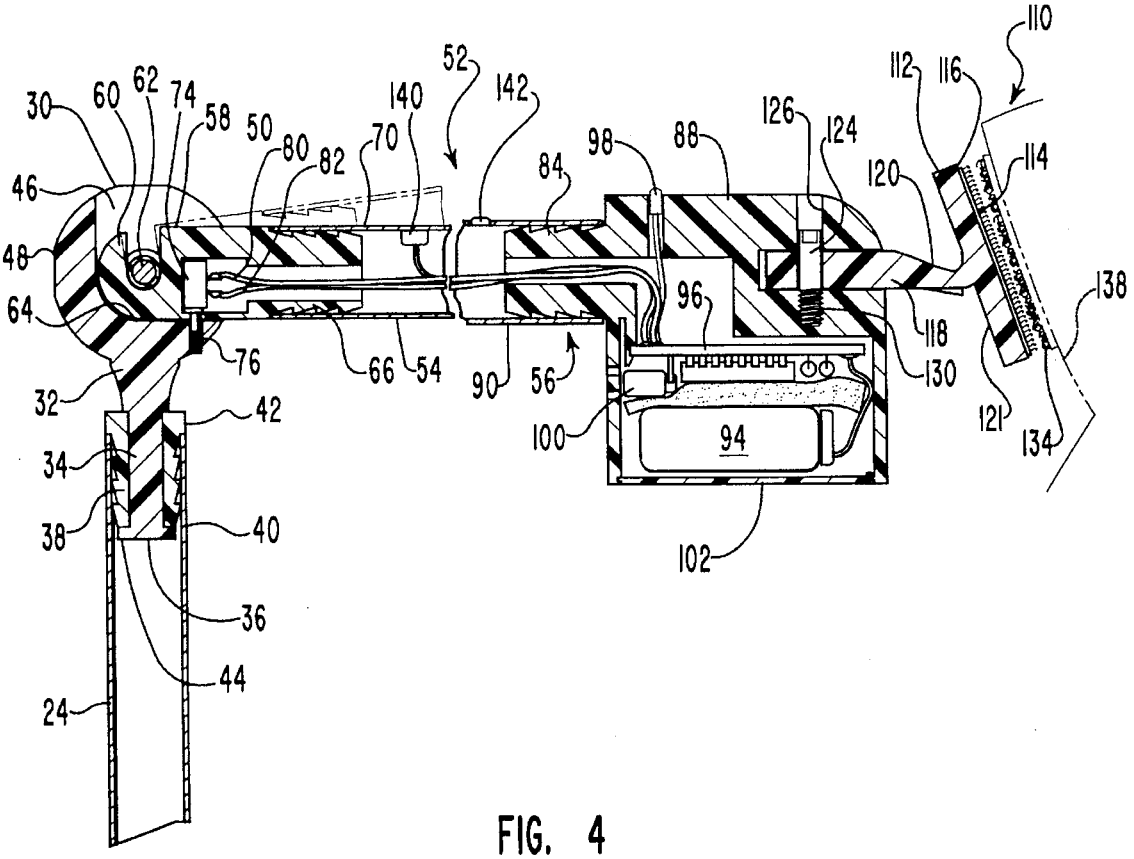
Figure 5:
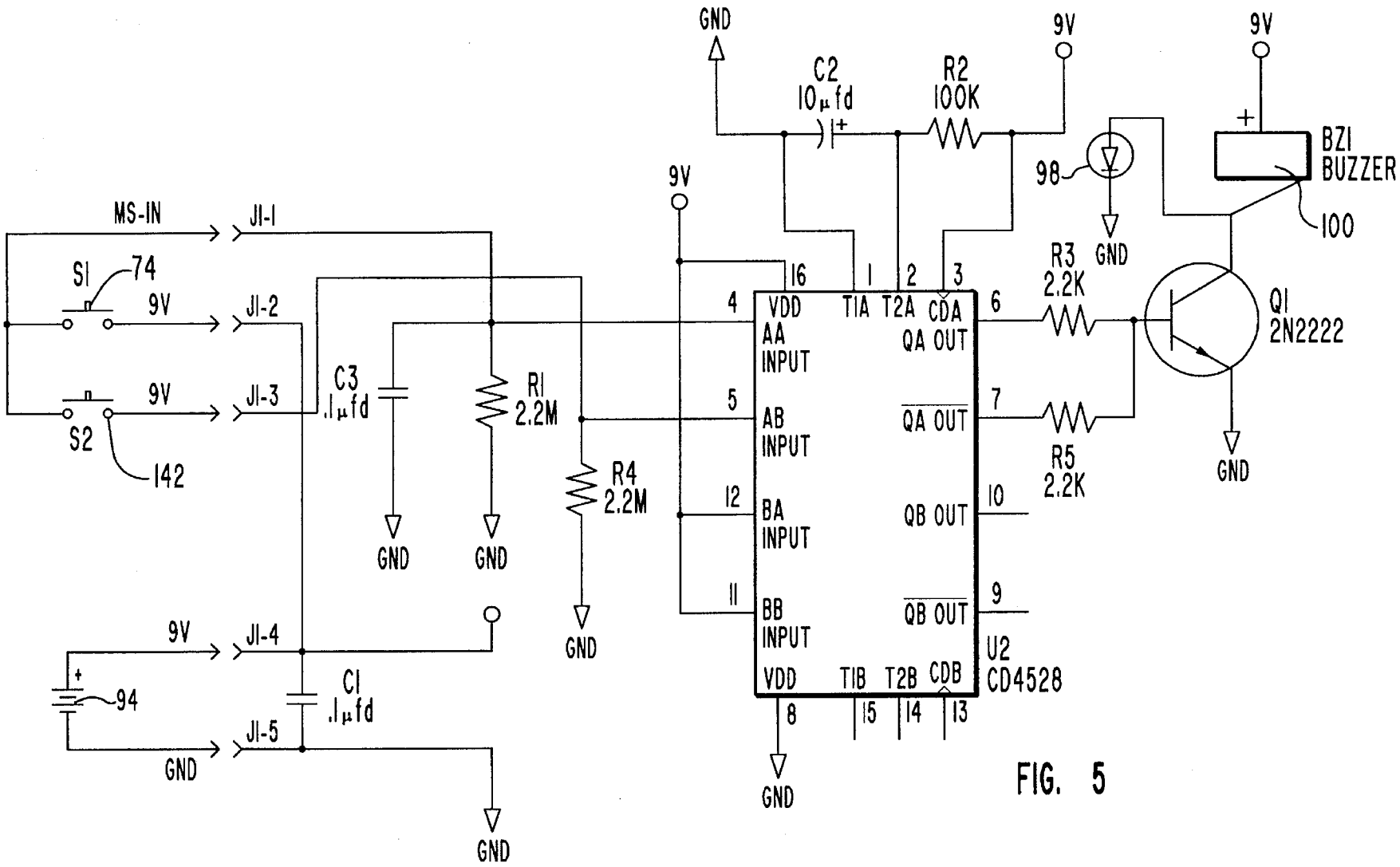
Figure 6:
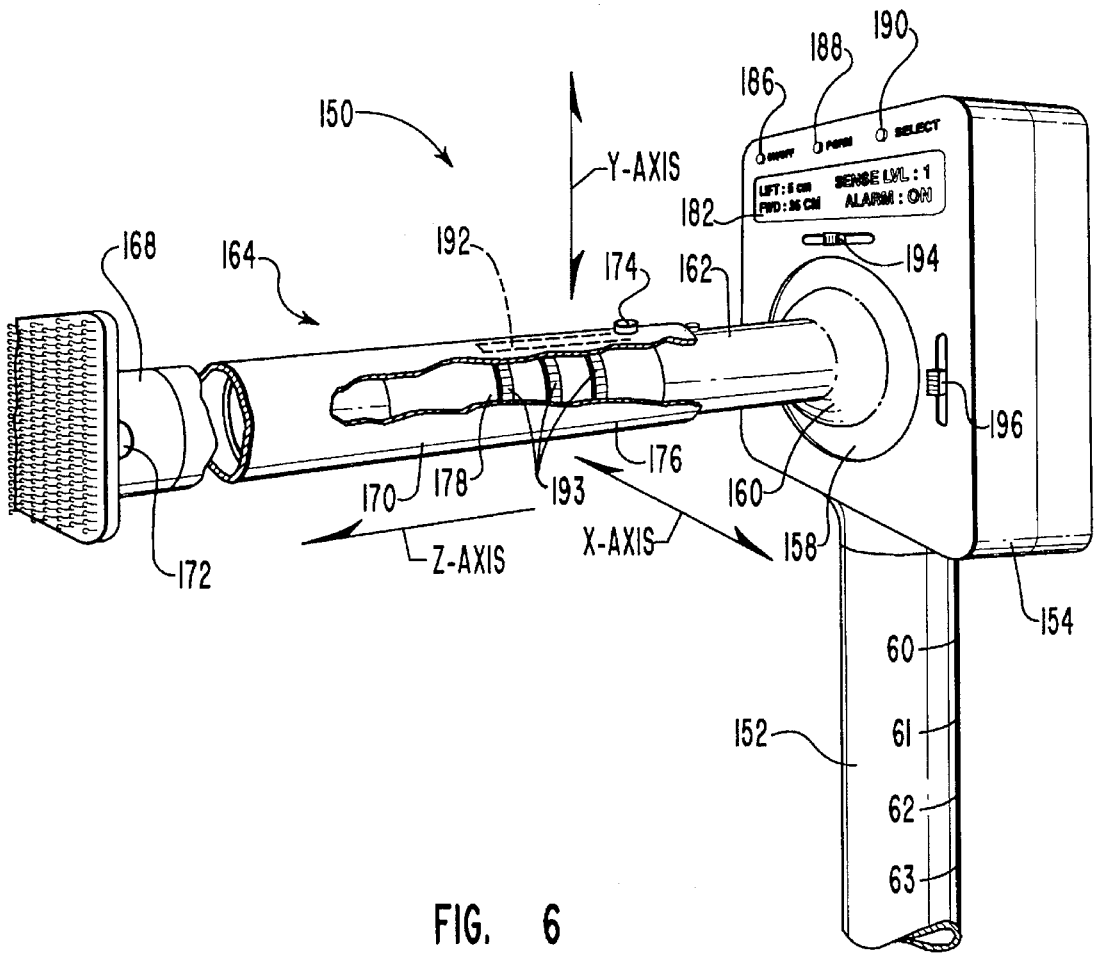
Figure 7:
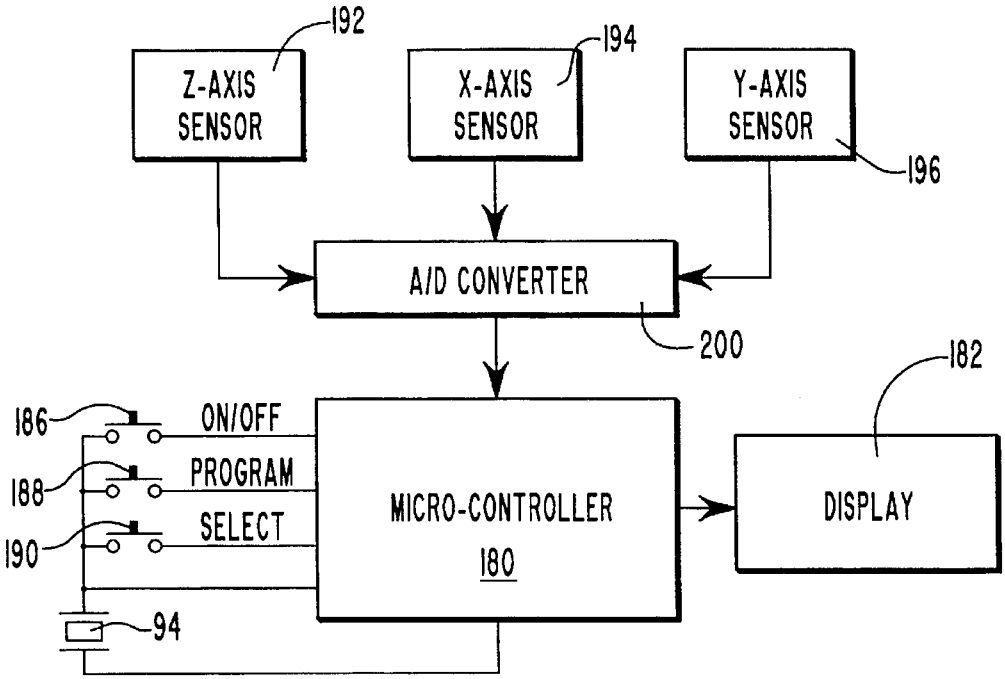

FIG. 3, a vertical section, taken on the line 3—3 of FIG. 2;

FIG. 4, a vertical section, taken on the line 4—4 of FIG. 2;

FIG. 5, a circuit diagram of the basic electrical circuit of the head movement detector of the invention;

FIG. 6, a fragmentary perspective view of another embodiment of the head movement detector of the invention; and FIG. 7 a block diagram showing an expanded electrical system for use with the head movement detector shown in FIG. 6.

DETAILED DESCRIPTION

Referring now to the drawings:

In the illustrated preferred embodiment shown in FIGS. 1–5 the head movement detector of the invention s shown generally at 10. As shown, the detector 10 includes a tripod base 12, with legs 14, 16, 18 projecting equiangularly from a center fitting 20. An outer tube 22 projects upwardly from the center fitting 20 and a calibrated tube 24 telescopes into the upper end of tube 22 to be locked in place by a set screw 26 threaded through the outer tube 28. The base 12, fitting 20, outer tube 22 and telescoping tube 24 form an adjustable upright mast, shown generally at 28.

A slotted ball 30 is formed at one end 32 of a support shaft 34, the other end 36 of which extends through a bearing 38 that is press fitted into the projecting end 40 of the telescoping tube 24. A shoulder 42 formed on end 32 rests on an upper end of bearing 38 and a shoulder 44 at the end 36 of the shaft 34 engages the other end of the bearing 38.

A slot 46 formed in the ball 30 extends from near one side of the ball at 48 fully through the ball to an opposite side 50.

A telescoping projecting arm 52 includes an inner sleeve 54 and an outer sleeve 56. A fitting 58 has a hook end 60 that hooks beneath and pivots around a pivot pin 62. Pivot pin 62 extends centrally through ball 30 and above the bottom 64 of the slot 46. Rotation of projecting arm 52 one-hundred eighty degrees about the pivot pin, from the use position of the projecting arm, allows the arm 52 to be lifted off pin 62 and the projecting arm 52 to be separated from the mast 28, for storage or the like. A reverse procedure is used to lock the projecting arm 52 to the mast 28.

An opposite end 66 of the fitting 58 is press fitted into the projecting end 70 of inner sleeve 54 of the projecting arm 52. A micro-switch 74 is mounted to extend through a slot 72 provided therefor in the hook end 60 of fitting 58. Switch 74 is actuated by engagement of the switch actuator with the end of a screw 76 threaded through the ball 30. The extend to which screw 76 is threaded into groove 46 of ball 34 determines the sensitivity of micro-switch 74. Wires 80 and 82 connect the micro-switch 74 through fitting 58, telescoping projecting arm 52 and a fitting 84, into a circuit housing 88. Fitting 84 is part of circuit housing 88 and is press fitted into the projecting end 90 of the outer sleeve 56 of the projecting arm 52 to thereby hold the circuit housing to the projecting arm.

The circuit housing has a battery 94, an array 96 of display lights 98 projecting through the wall of the housing and a sound emitter 100. A slide-in cover 102 for the circuit housing 88 is removable and replaceable to allow removal and installation of the battery 94. A headgear attachment assembly, shown generally at 110, is pivotally connected to the circuit housing 88. The headgear attachment assembly includes a plate 112 that extends angularly across the longitudinal axis of the projecting arm 52. A pad 114 of a conventional loop and hook connector is fixed to the face 116 of the plate 112, remote from the mast 24.

A pivot plate 118, having a flexible neck 120 is affixed to the opposite face 121 of plate 112 and extends into a slot 122 provided therefore in the housing 88. The pivot plate is held in place by a pivot pin 124 that extends down through a hole 126 in the circuit housing 88 and through the pivot plate 118 to be threaded into the housing 88 at 130. The flexible neck 120 allows for limited lifting and lowering head movement before detector indicators are activated. Likewise, the pivoting of the pivot plate allows for limited forward and back movement of the head of a user before detector indicators are activated.

Another pad 134 of co-operating hook and loop material is releasably connected to the pad 114. Pad 134 is attached to a cap 138 or other headgear worn by the user of the head movement detector 10.

A magnet 140 is fixed to the interior of end 70 of inner sleeve 72 of projecting arm 52. A magnet detector switch 142 is fixed to the outer surface of end 90 of the outer sleeve 56 of projecting arm. The magnet detector switch 142 is activated by movement of the sleeve 56 (and movement of the magnet detector switch 142) relative to the inner sleeve 72 (and the magnet 140). Thus, the magnet detector switch 142 is activated to operate the array 96 of lights 98 and the sound emitter 100 when the outer sleeve 56 is moved either longitudinally with respect to the inner sleeve 72, or turned with respect to the inner sleeve 72 about the longitudinal axis of projecting arm 56.

A typical electrical circuit that will activate the lights 98 and or buzzer 100 whenever the switch 74 or switch 142 are activated is shown generally at 148, FIG. 5.

FIGS. 6 and 7 show another embodiment of the head movement detector of the invention. In the embodiment disclosed, the head movement detector, shown generally at 150 includes an upright mast 152, corresponding to the mast 28, previously described. A circuit box 154 is mounted on the top of mast 152, has a socket 158 formed in a face thereof and a ball 160 mounted on one end of an inner sleeve 162 of a telescopic projecting arm 164.

The ball 160 is mounted and held in the socket such that the ball will fully swivel in and is spring centered in the socket. Such a ball and socket control structure is a conventional type "joy stick", is well known in the art and is therefore not discussed in detail herein. The free end 168 of the outer sleeve 170 has a pivot plate 172 (corresponding to the pivot plate 118 previously described) attached thereto, in the manner previously described.

A magnetic potentiometer 192, having a magnet 174 fixed to the exterior of the end 176 of the outer sleeve, moves with respect to magnetic fields 178 generated by coils 193 inside the inner sleeve 162 to provide signals to a micro-controller 180.

Potentiometers 192, 194, and 196 are operated by movement of ball 160 and movement of the inner sleeve 162. Movement in any horizontal, vertical or combination of both directions moves the slides of the potentiometers to generate signals that will be processed through the A/D convertor and micro-controller 180 to be displayed on display unit 182. The display unit 182 will indicate graduated displacement and leave displayed the maximum displacement of the outer sleeve 170 relative to the inner sleeve 162 (Z axis), horizontal movement (X axis) and vertical movement (Y axis). The sensitivity of the horizontal axis potentiometer and of the vertical axis potentiometer are adjusted by manual movement of slides 194 and 196, respectively, that extend through slots provided therefor in the face of circuit housing 154.

Display unit 182 is mounted in the face of circuit housing 154 and additionally includes push button switches 186 to turn the circuit on and off; 188 to select the program and sensitivity of the program to be activated; and 190 to select a function.

Although preferred embodiments of the invention have been herein disclosed, it is to be understood that such disclosure is by way of example and that other variations are possible without departing from the subject matter coming within the scope of the following claims, which subject matter I regard as my invention.

I claim:

1. A head movement detector comprising an upright mast including a support base;

a projection arm extending from and movable with respect to an upper end of said mast;

a headgear attachment assembly secured to the end of said projection arm remote from said mast;

means for detecting and indicating selected movement of said headgear attachment assembly relative to said mast; and means for permitting an allowable movement of said headgear attachment assembly with respect to said projection arm before said means for detecting and indicating selected movement of said headgear attachment assembly detects and indicates said selected movement of said headgear attachment.

2. A head movement detector as in claim 1, wherein said projection arm is mounted to pivot up and down in a plane of the mast and to swing around the upper end of said mast.

3. A head movement detector as in claim 2, wherein the means for permitting an allowable movement of the headgear attachment assembly with respect to the projection arm comprises a pivot connection between the projection arm and the headgear attachment assembly to allow horizontal movement of said headgear relative to the free end of said projection arm.

4. A head movement detector as in claim 3, wherein the means for permitting an allowable movement of the headgear attachment assembly with respect to the projection arm further comprises a flexible connection between the projection arm and the headgear assembly to allow vertical movement of said headgear relative to the free end of said projection arm.

5. A head movement detector as in claim 4, wherein the support base is a tripod and the mast further includes a first upright tubular post having one end fixed to the tripod, a second graduated tubular post telescoped with respect to said first upright tubular post and means to releasably lock said graduated tubular post to said first upright tubular post at a desired position relative thereto.

6. A head movement detector as in claim 5, further including a ball mounted to swivel on an upper end of the second graduated tubular post;

a slot in said ball; and means pivotally mounting the end of the projection arm connected to the top of the mast in said slot, whereby said projecting arm is pivotable up and down with respect to said mast.

7. A head movement detector as in claim 6, wherein the projection arm includes a first tubular sleeve member having one end pivotally mounted in the slot of the ball, and a another end telescoped into one end of a second tubular sleeve, the other end of which has the headgear attachment assembly secured thereto.

8. A head movement detector as in claim 7, wherein the means pivotally mounting the end of the projection arm connected to the top of the mast in said slot includes a pivot pin extending through said slot and a hook on one end of the first tubular sleeve of the projection arm and passed beneath the pivot pin during upward and downward movement of said projection arm and to be pivoted to a position extending over the pivot pin during removal of said projection arm from said ball.

9. A head movement detector as in claim 8, wherein the means for detecting and indicating selected movement of the headgear attachment assembly includes a screw adjustably threaded through a portion of the ball and an electrical switch mounted in and extending through the hook to engage said adjustable screw.

10. A head movement detector as in claim 9, wherein the means for detecting and indicating selected movement of the headgear attachment assembly further includes a magnet affixed to one of said tubular sleeves of said projection arm and a cooperating magnetic field responsive switch fixed to the other of said tubular sleeve, whereby said magnetic field responsive switch is actuated by movement thereof relative to said magnet.

11. A head movement detector as in claim 10, further including a circuit box interconnecting the projection arm and the headgear attachment assembly and containing a battery and signal devices responsive to actuation of the switch in the hook and the magnetic field responsive switch.

12. A head movement detector as in claim 11, further including a pivot pin extending downwardly into a wall of said circuit box and through a slot extending transverse to the axis of the pin and formed in said wall, and wherein the headgear attachment assembly includes a plate with a pad of a loop and hook connector on a face thereof and a pivot plate extending from an opposite face into said slot in a wall of said circuit box to be secured by said pivot pin passing therethrough, whereby said plate swings with respect to the end of said projecting arm.

13. A head movement detector as in claim 12, wherein the pivot plate has a flexible section therein to allow limited vertical travel of the headgear attachment assembly without movement of the projection arm.

14. A head movement detector as in claim 13, wherein the headgear attachment assembly further includes a cap to be worn by a user of the headgear movement detector and a cooperating pad of the loop and hook connector fixed to said cap and interlocked with the other pad of said loop and hook connector.

15. A head movement detector as in claim 2, wherein the means for permitting an allowable movement of the headgear attachment assembly with respect to the projection arm comprises a flexible connection between the projection arm and the headgear attachment assembly to allow vertical movement of said headgear relative to the free end of said projection arm.

16. A head movement detector as in claim 1, wherein the projection arm is connected to the mast by a circuit box having a socket formed in a face thereof and a ball on an end of the projection arm secured and pivotable in said socket.

17. A head movement detector as in claim 16, wherein the means for detecting and indicating selected movement of the headgear attachment assembly includes means for detecting vertical swinging movement of said projection arm, horizontal swinging movement of said projection arm, and longitudinal travel of a telescoping member of said projection arm relative to another member of said projection arm.

18. A head movement detector as in claim 17, further including means for adjusting movement of the projecting arm before activation of at least one means for detecting movement of said projecting arm.

* * * * *